United States Patent [19]

Boulton

[11] Patent Number: 4,571,288

[45] Date of Patent: Feb. 18, 1986

[54] PROCESS FOR THE ELECTROLYSIS OF AQUEOUS ALKALI METAL CHLORIDE SOLUTION

[75] Inventor: Thomas W. Boulton, Frodsham, England

[73] Assignee: Imperial Chemical Industries PLC, Hertfordshire, England

[21] Appl. No.: 669,633

[22] Filed: Nov. 7, 1984

[30] Foreign Application Priority Data

Nov. 14, 1983 [GB] United Kingdom ..... 8330322

[51] Int. Cl.[4] ..... C25B 1/16; C25B 1/46

[52] U.S. Cl. ..... 204/98; 204/1 R; 204/128; 204/255; 204/257

[58] Field of Search ..... 204/128, 252–258, 204/263–266, 1 R

[56] References Cited

U.S. PATENT DOCUMENTS

| | | | |
|---|---|---|---|
| 3,252,883 | 5/1966 | Schick | 204/255 |
| 3,778,362 | 12/1973 | Wiechers et al. | 204/254 |
| 4,048,045 | 9/1977 | Eng et al. | 204/257 |
| 4,053,385 | 10/1977 | Hirozawa | 204/254 |
| 4,197,178 | 4/1980 | Pellegri et al. | 204/255 |
| 4,214,969 | 7/1980 | Lawrance | 204/255 |
| 4,217,200 | 8/1980 | Kedem et al. | 204/296 |
| 4,219,394 | 8/1980 | Babinsky et al. | 204/98 |
| 4,252,628 | 2/1981 | Boulton et al. | 204/257 |
| 4,257,866 | 3/1981 | Belle et al. | 204/253 |
| 4,297,194 | 10/1981 | Dotson et al. | 204/257 |
| 4,339,322 | 7/1982 | Balko et al. | 204/255 |
| 4,396,484 | 8/1983 | Pere et al. | 204/257 |
| 4,402,813 | 9/1983 | Kircher et al. | 204/257 |
| 4,425,215 | 1/1984 | Henes | 204/258 |
| 4,434,858 | 2/1984 | Schmitt et al. | 204/257 |
| 4,464,243 | 8/1984 | Woolhouse | 204/257 |

FOREIGN PATENT DOCUMENTS

| | | | |
|---|---|---|---|
| 1159485 | 7/1969 | United Kingdom | 429/57 |
| 1318923 | 5/1973 | United Kingdom | 204/254 |
| 1341027 | 12/1973 | United Kingdom | 429/57 |
| 2087435A | 5/1982 | United Kingdom | 204/98 |

*Primary Examiner*—Andrew H. Metz
*Assistant Examiner*—Terryence Chapman
*Attorney, Agent, or Firm*—Cushman, Darby & Cushman

[57] ABSTRACT

A process for electrolysis of an electrolyte, e.g. aqueous alkali metal chloride solution in an electrolytic cell comprising a plurality of anodes and cathodes and separators positioned between adjacent anodes and cathodes to form in the cell a plurality of anode compartments and cathode compartment, the process comprising charging the electrolyte to the anode compartments, electrolyzing the electrolyte, and removing the products of electrolysis from the anode and cathode compartments, the anodes and cathodes comprising an electroconducting electrocatalytically-active portion affixed to a frame member of an electrically non-conducting plastics material, and the frame members being bonded directly or indirectly to each other. Also an electrolytic cell for use in the process.

29 Claims, 1 Drawing Figure

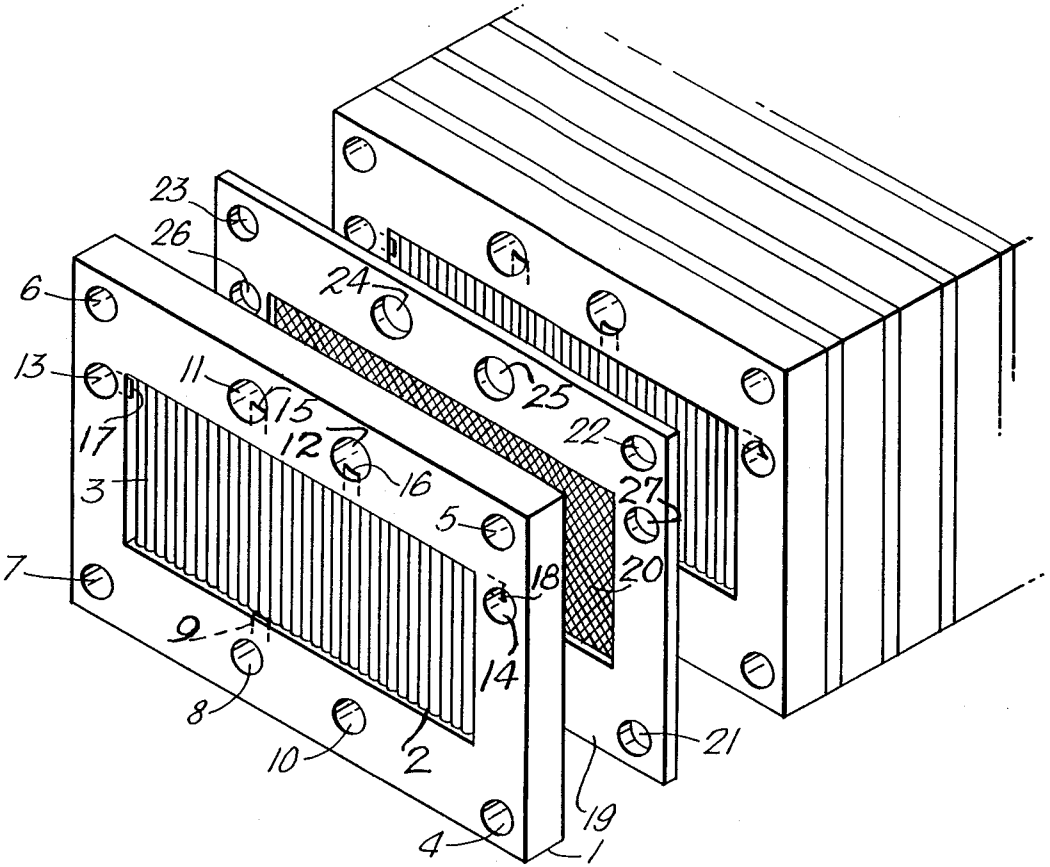
1
2
3
4
5
6
7
8
9
10
11
12
13
14
15
16
17
18
19
20
21
22
23
24
25
26
27

PROCESS FOR THE ELECTROLYSIS OF AQUEOUS ALKALI METAL CHLORIDE SOLUTION

This invention relates to a process for the electrolysis of an electrolyte, for example, an aqueous alkali metal chloride solution, and to an electrolytic cell for such electrolysis.

Electrolytes, for example, aqueous solutions of alkali metal chloride, particularly sodium chloride, are electrolysed on a vast scale throughout the world in order to produce products such as chlorine and aqueous alkali metal hydroxide solution. The electrolysis may be effected in an electrolytic cell comprising a plurality of anodes and cathodes with each anode being separated from the adjacent cathode by a separator which divides the electrolytic cell into a plurality of anode and cathode compartments.

The electrolytic cell is provided with means for feeding aqueous alkali metal chloride solution to the anode compartments of the cell, and with means for removing the products of electrolysis therefrom. Also, the electrolytic cell is provided with means for removing products of electrolysis from the cathode compartments of the cell, and optionally with means for feeding water or other fluid thereto.

The electrolytic cell may be of the diaphragm or membrane type. In the diaphragm type cell, the separator positioned between each adjacent anode and cathode is microporous and, in use, aqueous alkali metal chloride solution passes through the diaphragms from the anode compartments to the cathode compartments of the cell. In the membrane type cell the separators are essentially hydraulically impermeable and in use ionic species, that is alkali metal ions, are transported across the membranes between the anode compartments and the cathode compartments of the cell.

Where aqueous alkali metal chloride solution is electrolysed in an electrolytic cell of the diaphragm type the solution is fed to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be fed, and hydrogen and alkali metal hydroxide solution produced by the reaction of alkali metal ions with water are removed from the cathode compartments of the cell.

The electrolysis may be effected in an electrolytic cell of the filter press type which may comprise a large number of alternating anodes and cathodes, for example, fifty anodes alternating with fifty cathodes, although the cell may comprises even more anodes and cathodes, for example up to one hundred and fifty alternating anodes and cathodes.

In such electrolytic cells of the filter press type the anodes and cathodes, and generally gaskets of an electrically insulating material positioned at least between adjacent anodes and cathodes, are usually mounted on tie rods and are compressed on the rods in the form of a stack. For example, the rods may be screw-threaded and the stack of anodes, cathodes and gaskets may be compressed by means of bolts on the screw-threaded tie-rods.

Such electrolytic cells suffer from a disadvantage in that despite taking care to position the anodes, cathodes and gaskets correctly, it is difficult to apply an appropriate amount of compression evenly with the result that such cells have a tendency to suffer from leaks. In particular, such electrolytic cells suffer from problems of leakage at the interface between the anodes and/or cathodes and the gaskets, particularly when the cells are operated at a pressure above atmospheric pressure.

The present invention relates to a process for the electrolysis of an electrolyte such as an aqueous alkali metal chloride solution in an electrolytic cell in which the aforementioned disadvantage is substantially overcome.

According to the present invention there is provided a process for the electrolysis of an electrolyte in an electrolytic cell comprising a plurality of anodes and cathodes and a separator positioned between each anode and adjacent cathode to form in the cell a plurality of anode compartments and cathode compartments, the process comprising charging the electrolyte to the anode compartments, electrolysing the electrolyte, and removing the products of electrolysis from the anode and cathode compartments, characterised in that the anodes and cathodes comprise an electro-conducting electrocatalytically-active portion affixed to a frame member of an electrically non-conducting plastics material, and in that the frame members are bonded directly or indirectly to each other.

The process of the invention may be used to electrolyse any suitable electrolyte. However, it is particularly applicable to the electrolysis of an aqueous solution of an alkali metal chloride and it will be described hereafter by reference to such electrolysis.

In a further embodiment there is provided an electrolytic cell for such electrolysis.

In the electrolytic cell in which the process of the invention is effected the frame members to which the anodes and cathodes are affixed are bonded directly or indirectly to each other. For example, these frame members may be bonded directly to each other. Alternatively, these frame members may be positioned on either side of another frame member of an electrically non-conducting plastics material and each may be bonded to the other frame member.

In the electrolytic cell the frame members are not merely positioned next to each other and held against each other by compressive forces. The frame members are bonded directly or indirectly to each other thus substantially overcoming the problems of leakage associated with conventional electrolytic cells, particularly when such electrolytic cells are operated at a pressure above atmospheric pressure.

Although the process of the invention may be used to electrolyse any alkali metal chloride it will generally be used to electrolyse an aqueous solution of sodium chloride to produce chlorine, hydrogen, and an aqueous solution of sodium hydroxide.

The electrolytic cell may be a monopolar cell or a bipolar cell. In a monopolar electrolytic cell each anode is affixed to a frame member of an electrically non-conducting plastics material. The frame member may surround the electroconducting electrocatalytically active portion of the anode. Similarly, each cathode is affixed to a frame member of an electrically non-conducting plastics material which may surround the electroconducting electrocatalytically active portion of the cathode.

In a bipolar electrolytic cell an electrode having an anode face and a cathode face is affixed to a frame member of an electrically non-conducting plastics material which frame member may surround the electrode.

In a monopolar electrolytic cell a separator is positioned between each adjacent anode and cathode. In a bipolar electrolytic cell a separator is positioned between an anode face of an electrode and a cathode face of an adjacent electrode.

In the electrolytic cell the separator may be a microporous hydraulically permeable diaphragm or a substantially hydraulically impermeable ionically permselective membrane, for example a cation-exchange membrane.

The separator may be positioned between adjacent anode and cathode frame members. It may be sealed to one or the other or to both of the frame members, or it may merely be held in position by being trapped between the frame members. Thus, the separator may have a surface area greater than that of the anode or cathode but not so great as to cover the entire face of a frame member. The separator may be positioned in a recess in the frame member and sealed thereto. In this embodiment of the electrolytic cell the frame members of electrically non-conducting plastics material to which the anodes and cathodes are affixed are sealed directly to each other with a separator trapped therebetween.

In an alternative embodiment, the separator may be sealed to and, for example, positioned within a frame member of an electrically non-conducting plastics material other than those to which the anodes and cathodes are fixed. This separator frame member may be positioned between frame members to which anodes and frame members to which cathodes are affixed and be bonded thereto. In this case the anode and cathode frame members are bonded indirectly to each other via the separator frame member.

The electrolytic cell may comprise frame members of an electrically non-conducting plastics material other than those to which the anodes and cathodes are affixed or to which the separators are affixed. For example, the electrolytic cell may comprise such frame members having a central opening therein to provide in the electrolytic cell a space for the anode and cathode compartments. Such a frame member may be positioned in the electrolytic cell between the separator, or frame member associated with the separator, and an adjacent anode frame member, and between the separator, or frame member associated with the separator, and an adjacent cathode frame member. Alternatively, space for the anode and cathode compartments may be provided by using anode and cathode frame members, and/or separator frame members of a thickness such as to provide the required space. For example, the anode and cathode frame members may have a central opening therein in which the anode and cathode respectively are positioned and the frame members may have a thickness greater than that of the anode and cathode.

The frame members of the electrolytic cell are made of an electrically non-conducting plastics material, which may be thermoplastic or thermoset, and which may be of an elastomeric material.

The plastics material of the frame member is preferably resistant to corrosion by the electrolyte and the products of electrolysis, for example by aqueous alkali metal chloride solution, especially such a solution containing chlorine, by wet chlorine, and by aqueous alkali metal hydroxide solution.

The plastics material may be a polyolefin, for example, polyethylene, polypropylene, or an elastomeric polyolefin, e.g. an ethylene-propylene copolymer elastomer or an ethylene-propylene-diene copolymer elastomer. Polyolefins have the advantage that polyolefin frame members are readily bonded to each other by a number of different techniques, for example, heat welding, ultrasonic welding, or by the use of adhesives, as will be described in greater detail hereafter. However, polyolefins may not be sufficiently resistant to corrosion by the electrolyte and by the products of electrolysis and it is preferred, in order to increase the corrosion resistance, to provide a coating of a corrosion resistant material, for example a fluoropolymer, e.g. polytetrafluoroethylene, at least on those surfaces of the polyolefin frame members which in the cell contact the electrolyte and the products of electrolysis.

The plastics material may be a halogenated polyolefin, for example, polyvinyl chloride. Preferred halogenated polyolefins are fluorine-containing polyolefins, for example polyvinylidene fluoride, polyhexafluoropropylene, fluorinated ethylene-propylene copolymer, and particularly polytetrafluoroethylene, on account of the corrosion resistance of such fluorine-containing polyolefins. Such fluorine-containing polyolefins are not readily bonded by means of adhesives. They may be bonded by the use of heat welding or ultrasonic welding.

A preferred plastics material for use in the frame members is an acrylonitrile-butadiene-styrene polymer. Such plastics materials are well-known in the art and are readily available commercially. We have found that they are surprisingly resistant to corrosion by the electrolyte and by the products of electrolysis, and they possess the additional advantages that they are readily fabricated into frame members by a number of different plastics processing techniques, for example, injection moulding, compression moulding and extrusion, and that frame members of such a plastics material are readily bonded to each other by a number of different techniques.

The anodes and cathodes are affixed to frame members of an electrically non-conducting plastics material. The anodes and cathodes are positioned within the frame members and are affixed to the frame members and each comprises an electroconducting electrocatalytically active portion.

The anodes and cathodes must be electroconducting and they should have an electrocatalytically active surface. The anodes and/or cathodes may consist of a metallic substrate, which may have a forminate structure, for example it may be a perforated plate or be in the form of a mesh, e.g. a woven or non-woven mesh or an expanded metal. Alternatively, the anodes and/or cathodes may comprise a plurality of elongated members which are preferably parallel to each other and which are also preferably vertically disposed in the electrolytic cell.

A suitable metal for the anode is selected from the film-forming metals, for example, titanium, tantalum, zirconium, or hafnium.

A suitable metal for the cathode is nickel.

The anode and/or cathode may comprise a core of another metal having an outer face of one of the above metals.

Suitable electrocatalytically active coatings which may be applied to the surface of the anodes and/or cathodes include, in the case of anodes, an oxide of a platinum group metal preferably in admixture with an oxide of a film-forming metal, and, in the case of cathodes, a platinum group metal. Such coatings, and methods of application, are well-known in the art.

Where the electroconducting electrocatalytically active portion of the anode and/or cathode comprises a metallic member the latter may be affixed to the frame member of electrically non-conducting plastics material by, for example, moulding the plastics material into the form of a frame member around the anode or cathode. For example, the anode or cathode may be positioned in a mould and the plastics material may be moulded by compression moulding, by injection moulding, or by extrusion, into the form of a frame member around the anode or cathode.

The anode and/or the cathode may itself comprise a substrate of a plastics material which material may be the same as or different from the plastics material of the frame member. As the substrate must be electroconducting, and as plastics materials are generally electrically non-conducting, it follows that the plastic substrate must be modified so as to make it electroconducting. Such modification may be achieved in a number of different ways. For example, the substrate of plastics material may be filled with a substantial proportion of carbon black or graphite or particulate metal. It may comprise metallic fibre or non-metallic fibre having a coating of metal. The fibre may be randomly distributed throughout the substrate of plastics material. Alternatively, or in addition, the substrate of plastics material may have one or more foraminate metal members embedded therein, e.g. in the form of a mesh, which may be woven or unwoven or in the form of an expanded metal. The embedded metal member may act as a current distributor in the case where the anode or cathode is monopolar, in which case it may project from an edge of the plastics substrate and through the frame member in order to provide a means for electrical connection.

The substrate of plastics material may carry a metal layer on its face, for example a layer of a film-forming metal in the case of an anode, and a layer of nickel in the case of a cathode.

The substrate of plastics material may function as a bipolar electrode, in which case it may conveniently carry a layer of a film-forming metal on its anode face and a layer of nickel on its cathode face.

Where the anode and/or cathode is a metal coated substrate of a plastics material it is particularly suitable to use as the substrate an acrylonitrile-butadiene-styrene polymer material as such a material is readily metal coated.

Where the anode and/or cathode comprises a substrate of a plastics material the substrate is so modified as to decrease the electrical resistivity of the plastics material to a value which is preferably less than 0.1 ohm cm in the case of a bipolar electrode and to a value which is preferably less than 0.001 ohm cm in the case of a monopolar electrode.

The substrate of plastics material which forms the anode and/or cathode is affixed to a frame member of an electrically non-conducting plastics material. The frame member may be moulded to the anode and/or cathode of plastics material by the methods herein before described with reference to metallic anodes and/or cathodes, or the frame member may be bonded to the anode/or cathode substrate by means of an adhesive.

Where the separator is a hydraulically permeable diaphragm it may be made of a porous organic polymeric material. Preferred organic polymeric materials are fluorine-containing polymers on account of the generally stable nature of such materials in the corrosive environment encountered in chlor-alkali electrolytic cells. Suitable fluorine-containing polymeric materials include, for example, polychlorotrifluoroethylene, fluorinated ethylene-propylene copolymer, and polyhexafluoropropylene. A preferred fluorine-containing polymeric material is polytetrafluoroethylene on account of its great stability in corrosive chlor-alkali electrolytic cell environments.

Such hydraulically permeable diaphragm materials are known in the art.

Preferred separators for use as membranes which are capable of transferring ionic species between the anode and cathode compartments of an electrolytic cell are those which are cation perm-selective. Such ion exchange materials are known in the art and are preferably fluorine-containing polymeric materials containing anionic groups. The polymeric materials preferably are fluorocarbons containing the repeating groups.

$$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 600 to 2000, and X is chosen from $$A \text{ or } [OCF_2-\underset{\underset{Z}{|}}{CF}]_pA$$

where p has a value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or $-COOH$. $SO_3H$ group-containing ion exchange membranes are sold under the tradename 'Nafion' by E I du Pont de Nemours and Co Inc and —COOH group-containing ion exchange membranes under the tradename 'Flemion' by the Asahi Glass Co. Ltd.

In the electrolytic cell the means of bonding frame members of electrically non-conducting plastics material to each other will depend on the nature of the plastics material.

In general, bonding by means of adhesives may be effected with a wide variety of plastics materials of different types, for example, halogenated polyolefins, e.g. polyvinyl chloride, and plastics materials of the acrylonitrile-butadiene-styrene type. Of course, the nature of the adhesive will be selected for the particular plastics material which is to be bonded.

Thermal welding is a suitable means of effecting bonding of polyolefins, chlorinated polyolefins, e.g. polyvinyl chloride, and fluorine-containing polyolefins, and plastics materials of the acrylonitrile-butadiene-styrene type. Thermal welding may be effected for example, by positioning metallic wires, e.g. in the form of a tape, between adjacent frame members and applying pressure thereto. An electrical current may be passed through the wires to soften the plastics material and effect bonding.

Other methods of bonding which may be applied include solvent bonding and ultrasonic welding.

The electrolytic cell will be provided with means for feeding the aqueous alkali metal chloride solution to the anode compartments and with means for removing chlorine and optionally with means for removing depleted aqueous alkali metal chloride solution from the anode compartments, and the cathode compartments of the cell will be provided with means for removing hydrogen and cell liquor containing alkali metal hydroxide from the cathode compartments, and optionally, and if necessary, with means for feeding water or dilute alkali metal hydroxide solution to the cathode compartments.

Although it is possible for the means for feeding electrolyte and for removing products of electrolysis to be provided by separate pipes leading to or from each of the respective anode and cathode compartments in the cell such an arrangement may be unnecessarily complicated and cumbersome, particularly in an electrolytic cell of the filter press type which may comprise a large number of such compartments. A preferred type of electrolytic cell comprises frame members of plastics material having a plurality of openings therein which in the cell define separate compartments lengthwise of the cell and through which the electrolyte may be fed to the cell, e.g. to the anode compartments of the cell, and the products of electrolysis may be removed from the cell, e.g. from the anode and cathode compartments of the cell. The compartments lengthwise of the cell may communicate with the anode compartments and cathode compartments of the cell via channels in the frame members.

Where the electrolytic cell comprises hydraulically permeable diaphragms there may be two or three openings which define two or three compartments lengthwise of the cell from which electrolyte may be fed to the anode compartments of the cell and through which the products of electrolysis may be removed from anode and cathode compartments of the cell.

Where the electrolytic cell comprises cation permselective membranes there may be four openings which define four compartments lengthwise of the cell from which electrolyte and water or other fluid may be fed respectively to the anode and cathode compartments of the cell and through which the products of electrolysis may be removed from the anode and cathode compartments of the cell.

BRIEF DESCRIPTION OF THE DRAWING

An embodiment or the process of the present invention will now be described with the aid of the accompanying FIGURE which shows an isometric view of an electrolytic cell in which the process may be effected.

The electrolytic cell comprises a frame-like member (1) of an acrylonitrile-butadiene-styrene polymeric material (ABS) having a central opening in which a metallic bipolar electrode (2) is positioned. The electrode comprises a sheet of titanium having a plurality of vertically disposed ribs (3) bonded in face-to-face contact with a sheet of nickel (not shown) which is similarly ribbed. In the electroltyic cell the titanium sheet serves as the anode and the nickel sheet serves as the cathode.

The bipolar electrode (2) is positioned in the frame-like member (1) by positioning the electrode in a suitably shaped mould and charging ABS polymeric material into the mould, for example by injection moulding. The face of the titanium sheet having the ribs (3) carries a coating of an electro-conducting electrocatalytically active material, e.g. an $RuO_2/TiO_2$ coating.

The frame-like member (1) has four openings (4, 5, 6, 7) which serve as locations for tie rods used in assembly of the electrolytic cell, as hereinafter described.

The frame-like member (1) comprises a horizontally disposed opening (8) through the thickness of the frame-like member (1) and a vertically disposed channel (9) which leads from the opening (8) to the face of the ribbed titanium sheet of the bipolar electrode (2), and a horizontally disposed opening (10) through the thickness of the frame-like member (1) and a vertically disposed channel (not shown) which leads from the opening (10) to the face of the ribbed nickel sheet of the bipolar electrode (2).

Similarly, the frame-like member (1) comprises four horizontally disposed openings (11, 12, 13, 14) through the thickness of the frame-like member (1) and four channels (15, 16, 17, 18) respectively associated with said openings, the channels (16, 17) leading from the face of the ribbed titanium sheet of the bipolar electrode (2) to the openings (12, 13 respectively), and the channels (15, 18) leading from the face of the ribbed nickel sheet of the bipolar electrode (2) to the openings (11, 14 respectively).

The electrolytic cell also comprises a frame-like member (19) of ABS polymeric material having a central opening in which a cation permselective membrane (20) is positioned. The membrane is slightly larger than the central opening in the frame-like member (19) and may be affixed thereto by means of an adhesive. Alternatively, the membrane (20) may be sandwiched between a pair of frame-like sections which are bonded together to form the frame-like member (19). The frame-like member (19) comprises four openings (21, 22, 23 one not shown) corresponding in position to the openings (4, 5, 6, 7) in the frame-like member (1) and which serve as locations for tie rods used in assembly of the electrolytic cell, and six horizontally disposed openings (24, 25, 26, 27 two not shown) corresponding in positon to the openings (8, 10, 11, 12, 13, 14) in the frame-like member (1).

In assembling the electrolytic cell a frame-like member (1) is positioned on four tie rods through the openings (4, 5, 6, 7) and a face of the member (1) is coated with an adhesive comprising ABS polymeric material in an organic solvent, e.g. perchlorethylene. A frame-like member (19) is then positioned on the tie-rods and contacted with the adhesive-coated face of the frame-like member (1). The opposite face of the frame-like member (19) is similarly coated with adhesive and another frame-like member (1) is positioned on the tie rods and contacted with the adhesive coated face of the frame-like member (19). In this way a stack of frame-like members (1) comprising bipolar electrodes and frame-like members (19) comprising cation permselective membranes is built up, the stack is held in compression until the frame-like members are firmly bonded together, and the tie rods are removed.

In the electrolytic cell the anode compartments are formed by the space between the ribbed titanium face of the bipolar electrode (2) and the adjacent membrane (20), and the cathode compartments by the space between the ribbed nickel face of the bipolar electrode (2) and the adjacent membrane (20).

In the electrolytic cell the horizontally disposed openings (8, 10, 11, 12, 13, 14) in the frame-like members (1) and the corresponding openings (24, 25, 26, 27 two not shown) in the frame-like members (19) together form channels lengthwise of the cell through which, respectively aqueous alkali metal chloride solution may be charged to the anode compartments of the cell, water or dilute aqueous alkali metal hydroxide solution may be charged to the cathode compartment of the cell, hydrogen produced by electrolysis may be removed from the cathode compartments, chlorine produced by electrolysis may be removed from the anode compartments, depleted aqueous alkali metal chloride solution may be removed from the anode compartments, and aqueous alkali metal hydroxide solution produced by electrolysis may be removed from the cathode compartments.

Assembly of the electrolytic cell is completed by sealing end plates (not shown) to each end of the cell, completing electrical connections, and connecting to appropriate headers the channels of which the openings (8, 10, 11, 12, 13 and 14) form a part.

In operation aqueous alkali metal chloride solution is charged to the anode compartments of the electrolytic cell through the lengthwise channel of which opening (8) forms a part and through vertically disposed channel (9), and depleted alkali metal chloride solution and chlorine produced in the electrolysis are removed from the anode compartments, respectively, through the channel (17) and the lengthwise channel of which opening (13) forms a part, and through channel (16) and the lengthwise channel of which opening (12) forms a part.

Water or dilute alkali metal hydroxide solution is charged to the cathode compartments of the electrolytic cell through the lengthwise channel of which opening (10) forms a part and through a vertically disposed channel (not shown), and alkali metal hydroxide solution and hydrogen produced in the electrolysis are removed from the cathode compartments, respectively, through the channel (18) and the lengthwise channel of which opening (14) forms a part, and through channel (15) and the lengthwise channel of which opening (11) forms a part.

I claim:

1. A process for the electrolysis of an electrolyte in an electrolytic cell comprising a plurality of anodes and cathodes, a separator positioned between each of the adjacent anodes and cathodes to form in the cell a plurality of anode compartments and cathode compartments, the process comprising charging the electrolyte to the anode compartments, electrolyzing the electrolyte, and removing the products of electrolysis from the anode and cathode compartments, the improvement which comprises effecting the electrolysis in an electrolytic cell in which the anodes and cathodes each comprise an electro-conducting electrocatalytically-active portion affixed to a frame member of an electrically non-conducting plastics material, and in which the frame members are bonded directly or indirectly to each other.

2. A process as claimed in claim 1 characterised in that the electrolyte is an aqueous solution of an alkali metal chloride.

3. A process as claimed in claim 1 or claim 2 characterised in that the electrolytic cell is a monopolar cell and each anode is affixed to a frame member and each cathode is affixed to a frame member.

4. A process as claimed in claim 1 or claim 2 characterised in that the electrolytic cell is a bipolar cell and in that an electrode having an anode face and a cathode face is affixed to a frame member.

5. A process as claimed in claim 1 or 2 characterised in that the separator is sealed to a frame member of an electrically non-conducting plastics material other than those to which the anodes and cathodes are fixed.

6. A process as claimed in claim 1 characterised in that the electrolytic cell comprises frame members having a central opening therein which provide a space for the anode and cathode compartments.

7. A process as claimed in claim 6 characterised in that the anode and cathode frame members have a central opening therein and a thickness greater than that of the anode or cathode fixed thereto.

8. A process as claimed in claim 1 characterised in that the electrically non-conducting plastics material of the frame member comprises a polyolefin.

9. A process as claimed in claim 8 characterised in that the electrically non-conducting plastics material of the frame member comprises a halogenated polyolefin.

10. A process as claimed in claim 8 characterised in that the electrically non-conducting plastics material of the frame member comprises an acrylonitrile-butadiene-styrene polymer.

11. A process as claimed in claim 1 or 2 characterised in that the anodes and cathodes comprise metallic substrates.

12. A process as claimed in claim 1 or 2 characterised in that the separator is a hydraulically permeable diaphragm.

13. A process as claimed in claim 1 or 2 characterised in that the separator is a cation perm-selective membrane.

14. A process as claimed in claim 1 or 2 characterised in that the frame members of electrically non-conducting plastics material are bonded to each other by means of thermal welding.

15. A process as claimed in claim 1 or 2 characterised in that the frame members of electrically non-conducting plastics material are bonded to each other by means of an adhesive.

16. An electrolytic cell comprising a plurality of anodes and cathodes and a separator positioned between each anode and adjacent cathode to form in the cell a plurality of anode compartments and cathode compartments, the electrolytic cell also comprising means for charging electrolyte to the anode compartments and for removing products of electrolysis from the anode and cathode compartments, the improvement which comprises affixing the anodes and cathodes, each of which comprises an electro-conducting electrocatalytically-active portion, to a frame member of an electrically non-conducting plastics material, and in which the frame members are bonded directly or indirectly to each other.

17. An electrolytic cell as claimed in claim 16 characterised in that the cell is a monopolar cell and in that each anode is affixed to a frame member and each cathode is affixed to a frame member.

18. An electrolytic cell as claimed in claim 16 characterised in that the electrolytic cell is a bipolar cell and in that an electrode having an anode face and a cathode face is affixed to a frame member.

19. An electrolytic cell as claimed in any one of claims 16 or 18 characterised in that the separator is sealed to a frame member of an electrically non-conducting plastics material other than those to which the anodes and cathodes are fixed.

20. An electrolytic cell as claimed in any one of claims 16 to 18 characterised in that the electrolytic cell comprises frame members having a central opening therein which provide a space for the anode and cathode compartments.

21. An electrolytic cell as claimed in any one of claims 16 to 18 characterised in that the anode and cathode frame members have a central opening therein and a thickness greater than that of the anode or cathode fixed thereto.

22. An electrolytic cell as claimed in any one of claims 16 to 18 characterised in that the electrically non-conducting plastics material of the frame member comprises a polyolefin.

23. An electrolytic cell as claimed in any one of claims 16 to 18 characterised in that the electrically non-conducting plastics material of the frame member comprises a halogenated polyolefin.

24. An electrolytic cell as claimed in any one of claims 16 to 18 characterised in that the electrically non-conducting member comprises an acrylonitrile-butadiene-styrene polymer.

25. An electrolytic cell as claimed in any one of claims 16 to 18 characterised in that the anodes and cathodes comprise metallic substrates.

26. An electrolytic cell as claimed in any one of claims 16 to 18 characterised in that the separator is a hydraulically permeable diaphragm.

27. An electrolytic cell as claimed in any one of claims 16 to 18 characterised in that the separator is a cation perm-selective membrane.

28. An electrolytic cell as claimed in any one of claims 16 to 18 characterised in that the frame members of electrically non-conducting plastics material are bonded to each other by means of thermal welding.

29. An electrolytic cell as claimed in any one of claims 16 to 18 characterised in that the frame members of electrically non-conducting plastics material are bonded to each other by means of an adhesive.

* * * * *